US011002164B2

(12) United States Patent
Kuebler et al.

(10) Patent No.: US 11,002,164 B2
(45) Date of Patent: May 11, 2021

(54) INTERNAL COMBUSTION ENGINE

(71) Applicant: Dr. Ing. h.c. F. Porsche Aktiengesellschaft, Stuttgart (DE)

(72) Inventors: Simon Kuebler, Stetten am Heuchelberg (DE); Andreas Kramer, Erdmannhausen (DE); Norman Woeckel, Moensheim (DE); Nico Bieber, Ditzingen (DE); Markus Spoth, Langenenslingen (DE); Manuel Buljac, Karlsruhe (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 0 days.

(21) Appl. No.: 15/182,910

(22) Filed: Jun. 15, 2016

(65) Prior Publication Data

US 2016/0369672 A1 Dec. 22, 2016

(30) Foreign Application Priority Data

Jun. 18, 2015 (DE) ..... 10 2015 109 802.4

(51) Int. Cl.

| | |
|---|---|
| ***F01M 11/02*** | (2006.01) |
| ***F01M 1/12*** | (2006.01) |
| ***F01M 5/00*** | (2006.01) |
| ***F01M 1/10*** | (2006.01) |

(52) U.S. Cl.

CPC ..... *F01M 11/02* (2013.01); *F01M 1/10* (2013.01); *F01M 1/12* (2013.01); *F01M 5/002* (2013.01); *F01M 2001/126* (2013.01); *F01M 2011/026* (2013.01); *F01M 2011/027* (2013.01)

(58) Field of Classification Search

CPC ..... F01M 11/02; F01M 5/002; F01M 1/12; F01M 1/10; F01M 2011/027; F01M 2011/026; F01M 2001/126

See application file for complete search history.

(56) References Cited

U.S. PATENT DOCUMENTS

| | | | | |
|---|---|---|---|---|
| 5,507,259 | A | 4/1996 | Tanaka | |
| 5,875,754 | A | 3/1999 | Ickinger | |
| 5,887,565 | A * | 3/1999 | Ozeki | F01M 11/02 123/196 R |

(Continued)

FOREIGN PATENT DOCUMENTS

| | | |
|---|---|---|
| DE | 4428681 C2 | 5/1997 |
| DE | 19619183 C1 | 7/1997 |

(Continued)

OTHER PUBLICATIONS

German Office Action dated Mar. 2, 2017.

*Primary Examiner* — Joseph J Dallo
*Assistant Examiner* — Kurt Philip Liethen
(74) *Attorney, Agent, or Firm* — Gerald E. Hespos; Michael J. Porco; Matthew T. Hespos

(57) ABSTRACT

An internal combustion engine has an oil circuit for supplying oil to powertrain components and cylinder head components of the internal combustion engine. At least one oil pump and one oil filter module are incorporated into the oil circuit. The oil circuit branches into a powertrain oil gallery and a cylinder head oil gallery in the oil filter module or downstream of the oil filter module in a flow direction. The oil circuit is designed so that a lower oil pressure prevails in the powertrain oil gallery than in the cylinder head oil gallery.

3 Claims, 1 Drawing Sheet

(56) References Cited

U.S. PATENT DOCUMENTS

| | | | | |
|---|---|---|---|---|
| 6,598,705 | B2 * | 7/2003 | Ito | F01M 1/12 137/115.13 |
| 6,860,250 | B1 * | 3/2005 | Plenzler | F01L 1/34 123/196 R |
| 7,007,648 | B2 * | 3/2006 | Fujikubo | F01L 1/022 123/90.27 |
| 7,287,507 | B2 | 10/2007 | Futamura et al. | |
| 7,717,081 | B2 * | 5/2010 | Yamada | F02F 1/40 123/193.5 |
| 8,794,210 | B2 * | 8/2014 | Liimatta | F01M 1/12 123/196 R |
| 2002/0003063 | A1 | 1/2002 | Ito et al. | |
| 2004/0104074 | A1 * | 6/2004 | Nakai | F01M 11/02 184/6.5 |
| 2006/0231057 | A1 | 10/2006 | Futamura et al. | |
| 2008/0190394 | A1 * | 8/2008 | Edelmayer | F01L 13/0005 123/193.5 |
| 2010/0284823 | A1 | 11/2010 | Reynolds et al. | |
| 2013/0174802 | A1 | 7/2013 | Liimatta et al. | |
| 2014/0345560 | A1 | 11/2014 | Liimatta et al. | |
| 2015/0275713 | A1 * | 10/2015 | Bidner | F01M 1/02 123/41.42 |
| 2015/0369098 | A1 * | 12/2015 | Barnes | F02F 1/24 123/193.5 |
| 2017/0354933 | A1 * | 12/2017 | Rupp | B01D 69/08 |

FOREIGN PATENT DOCUMENTS

| | | | |
|---|---|---|---|
| DE | 10 2010 018 852 | | 12/2010 |
| DE | 10122356 | A1 | 11/2011 |
| DE | 102013100018 | A1 | 7/2013 |
| EP | 1598531 | B1 | 4/2012 |

* cited by examiner

INTERNAL COMBUSTION ENGINE

CROSS REFERENCE TO RELATED APPLICATION

This application claims priority under 35 USC 119 to German Patent Appl. No. 10 2015 109 802.4 filed on Jun. 18, 2015, the entire disclosure of which is incorporated herein by reference.

BACKGROUND

1. Field of the Invention

The invention relates to an internal combustion engine having an oil circuit for supplying oil to powertrain components and cylinder head components of the internal combustion engine. At least one oil pump and one oil filter module are incorporated into the oil circuit. The oil circuit branches into a powertrain oil gallery and a cylinder head oil gallery in the oil filter module or downstream of the oil filter module in a flow direction.

2. Description of the Related Art

DE 10 2010 018 852 A1 discloses an internal combustion engine with an oil pump to draw engine oil from an oil pan and to deliver the oil under pressure via an oil filter to a main oil gallery. The main oil gallery branches into separate sub-galleries for feeding to powertrain components, such as crankshaft bearings, and cylinder head components, such as camshaft phase adjusters and camshaft bearings.

The oil circuit functions to supply engine oil to various components of the internal combustion engine. The components to which a supply is to be provided are very different and include both bearing points of shafts, such as crankshafts, camshafts and connecting rods, and also hydraulic and switchable consumers and valve drive components in the cylinder head of the internal combustion engine. These different components typically have different requirements with regard to oil pressure and oil volume flow.

It is an object of the invention to provide an internal combustion engine that enables the oil volume flow to be adapted more effectively and in a simple manner to the respective requirements of the components to which oil is to be supplied.

SUMMARY

The invention relates to an internal combustion engine having an oil circuit for the supply of oil to powertrain components and cylinder head components of the internal combustion engine. At least one oil pump and one oil filter module are incorporated into the oil circuit. The oil circuit branches into a powertrain oil gallery and a cylinder head oil gallery in the oil filter module or downstream of the oil filter module in a flow direction. The oil circuit is designed so that a lower oil pressure prevails in the powertrain oil gallery than in the cylinder head oil gallery.

The internal combustion engine of the invention advantageously is configured so that a lower oil pressure is generated in the powertrain oil gallery than in the cylinder head oil gallery. In this way, hydraulic oil consumers in the oil circuit that normally are in the region of the cylinder head of the internal combustion engine always are supplied with a higher oil pressure level than the powertrain components. The branching point of the oil circuit, and in particular the powertrain oil gallery and the cylinder head oil gallery in the region of the branching point, may be designed so that a lower oil pressure prevails in the powertrain oil gallery than in the cylinder head oil gallery. The powertrain components may comprise at least crankshaft bearings and connecting rod bearings, whereas the cylinder head components may comprise hydraulic consumers, camshaft bearings and/or valve drive components. The oil circuit further may be part of a dry-sump lubrication arrangement.

The diameter of the powertrain oil gallery in a sub-region downstream of the branching point may be greater than the diameter of the cylinder head oil gallery. Thus, different volume flows and oil pressure levels are provided in a simple manner by the different diameters for the powertrain oil gallery and for the cylinder head oil gallery. This adaptation of the diameter enables the volume flow and oil pressure level to be adapted to the hydraulic oil consumers in optimum fashion.

The quotient of the diameter of the powertrain oil gallery and the diameter of the cylinder head oil gallery may lie between 1.2 and 2.0. It has been found that this diameter ratio can achieve an optimum distribution of the oil pressure level for the cylinder head components and the powertrain components.

Further details, features and advantages of the invention will emerge from the drawings and from the following description of preferred embodiments on the basis of the drawings. The drawings illustrate merely exemplary embodiments of the invention and do not restrict the essential concept of the invention.

DETAILED DESCRIPTION

Figure 1:
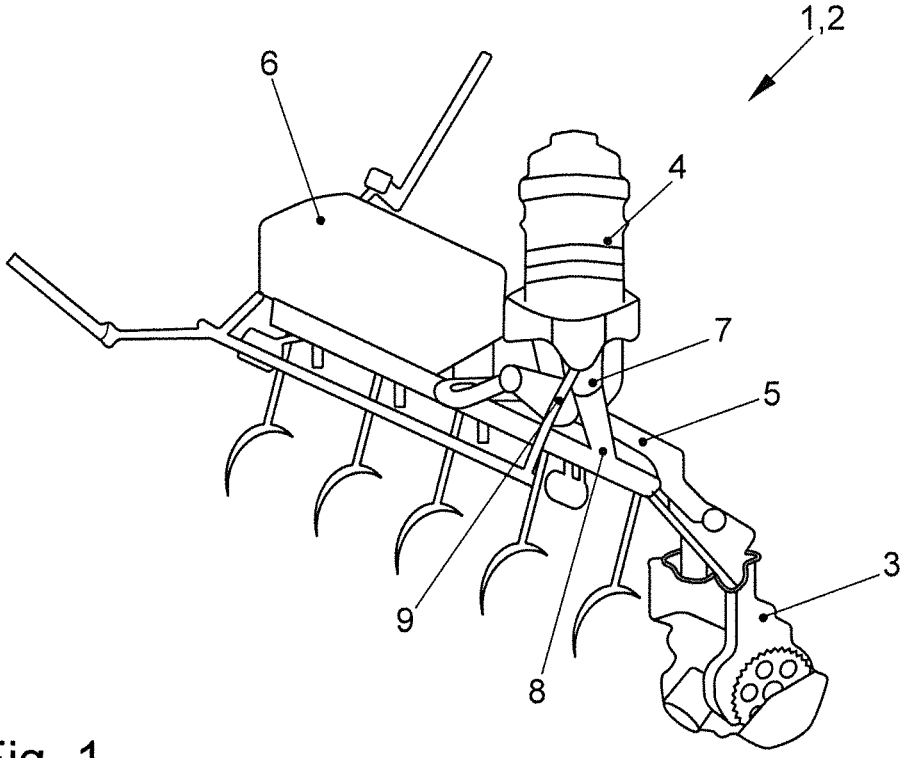
FIG. 1 illustrates a schematic detail view of an internal combustion engine 1 as per an exemplary embodiment of the present invention.

The internal combustion engine 1 has an oil circuit 2 for engine oil, by way of which the various components of the internal combustion engine 1 are supplied with engine oil. FIG. 1 shows said oil circuit 2, whereas, for the sake of clarity, the other parts of the internal combustion engine 1 are not illustrated.

The oil circuit 2 comprises an oil pump 3 for delivering the engine oil under pressure through the oil circuit 2. Furthermore, an oil filter module 4 is incorporated into the oil circuit 2 downstream of the oil pump 3 as viewed in a flow direction of the engine oil.

The engine oil is drawn from the oil pan (not illustrated) of the internal combustion engine 1, and supplied via a feed line 5 to the oil filter module 4 by the oil pump 3. In the present example, the oil circuit 2 further has an oil cooler 6. The oil cooler 6 may be water-cooled and is arranged between the oil pump 3 and the oil filter module 4 as viewed in the flow direction of the engine oil. The internal combustion engine 1 also may have a dry-sump lubrication arrangement, so that the oil circuit 2 comprises further oil pumps (not illustrated).

The oil filter module 4 has an outlet bore 7 through which the filtered engine oil exits the oil filter module 4 again. The outlet bore 7 opens into a powertrain oil gallery 8 to conduct the engine oil that emerges from the oil filter module 4 to powertrain components (not illustrated) of the internal combustion engine 1. The powertrain components are, for example, the crankshaft bearings and connecting rod bearings of the internal combustion engine 1, and preferably piston spray nozzles.

A cylinder head oil gallery 9 branches off from the outlet bore 7. The cylinder head oil gallery 9 conducts engine oil that emerges from the oil filter module 4 to cylinder head components (not illustrated) of the internal combustion engine 1. These cylinder components are bearing elements, such as camshaft bearings, valve drive components and hydraulic oil consumers that typically require a higher oil pressure level than, for example, the powertrain components. Alternatively, the cylinder head oil gallery 9 may not originate from the outlet bore 7 but may be directly, in parallel with the powertrain oil gallery 8, from the oil filter module 4.

The oil circuit 2 is designed so that a lower oil pressure prevails in the powertrain oil gallery 8 than in the cylinder head oil gallery 9 to allow for the different requirements with regard to the oil pressure level. The different oil pressure levels are achieved in that the powertrain oil gallery 8 has a larger diameter 11 than the cylinder head oil gallery 9 at least in the region of the branching point. The oil circuit 2 is thus advantageously separated, downstream of the oil filter module 4, into a high-pressure region (cylinder head oil galleries) and a low-pressure region (powertrain oil galleries).

Figure 2:
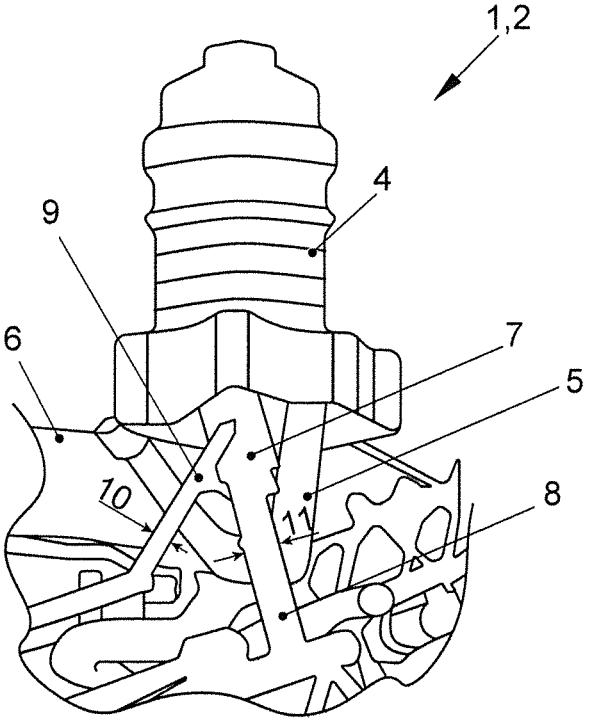
FIG. 2 is a detail view of the underside of the oil filter module.

FIG. 2 illustrates a detail view of the underside of the oil filter module 4, from which the outlet bore 7 projects. The cylinder head oil gallery 9 extends laterally from the outlet bore 7 and has a diameter 10 that is smaller than the diameter 11 of the powertrain oil gallery 8, into which the outlet bore 7 opens along a straight path.

It has proven to be particularly advantageous if the quotient of the diameter 11 of the powertrain oil gallery 8 and the diameter 10 of the cylinder head oil gallery 9 lies between 1.2 and 2.0.

What is claimed is:

1. An internal combustion engine comprising:

powertrain components that include crankshaft bearings and connecting rod bearings;

cylinder head components that include hydraulic consumers, camshaft bearings and/or valve drive components; and an oil circuit for supplying oil to the powertrain components and the cylinder head components of the internal combustion engine, an oil pump and one oil filter module being incorporated into the oil circuit, the oil circuit including:

an outlet bore extending down from the oil filter module, a powertrain oil gallery extending along a straight path from the outlet bore, and a cylinder head oil gallery branching laterally from the outlet bore at a branching point downstream of the oil filter module and upstream of both the powertrain oil gallery and the cylinder head oil gallery in a flow direction so that an oil flow from the outlet bore is divided at the branching point upstream of both the powertrain oil gallery and the cylinder head oil gallery into separate oil flows going respectively to the powertrain oil gallery and the cylinder head oil gallery, a diameter of the powertrain oil gallery being greater than a diameter of the cylinder head oil gallery at least in a sub-region downstream of the branching point, wherein the greater diameter of the powertrain oil gallery and the straight path of the powertrain oil gallery from the outlet bore ensures that a lower oil pressure and a higher volume flow of oil prevails in the powertrain oil gallery than in the cylinder head oil gallery that branches laterally from the outlet bore, and wherein a quotient of the diameter of the powertrain oil gallery and the diameter of the cylinder head oil gallery is between 1.2 and 2.0.

2. The internal combustion engine of claim 1, wherein the oil circuit is part of a dry-sump lubrication arrangement.

3. The internal combustion engine of claim 1, further comprising an oil cooler between the oil pump and the oil filter module.

* * * * *